United States Patent [19]

Chaffy et al.

[11] Patent Number: 4,696,730

[45] Date of Patent: Sep. 29, 1987

[54] CIRCUIT FOR THE ELECTRICAL CONNECTION OF ROWS OF ELECTROLYSIS CELLS FOR THE PRODUCTION OF ALUMINUM AT VERY HIGH CURRENT

[75] Inventors: Joseph Chaffy; Bernard Langon, both of Saint Jean de Maurienne, France

[73] Assignee: Aluminium Pechiney, Paris, France

[21] Appl. No.: 870,850

[22] Filed: Jun. 5, 1986

[30] Foreign Application Priority Data

Jun. 5, 1985 [FR] France ..... 85 08923

[51] Int. Cl.[4] ..... C25C 3/16

[52] U.S. Cl. ..... 204/243 M; 204/244

[58] Field of Search ..... 204/244, 243 M

[56] References Cited

U.S. PATENT DOCUMENTS 4,396,483 8/1983 Schmidt-Hatting ..... 204/243 M 4,462,885 7/1984 Kato et al. ..... 204/243 M

*Primary Examiner*—Donald R. Valentine

*Attorney, Agent, or Firm*—Dennison, Meserole, Pollack & Scheiner

[57] ABSTRACT

The invention relates to a circuit for electrical connection between the cells of a row designed for the production of aluminium by electrolysis, by the Hall-Heroult process. It is applied to rows of cells arranged transversely to the axis of the row operating at a current higher than 250,000 amperes and possibly attaining from 300 to 600 kA. An anode frame 6 of the cell of rank n+1 in each line is supplied with current simultaneously by a plurality of upstream risers such as 11, 12, 13 which are substantially equidistant and symmetrical about the vertical plane containing the small axis 1 of the cell and by at least two downstream risers 15, 15S which are substantially symmetrical about this same vertical plane, these downstream risers 15, 15S being supplied by conductors connected to the downstream cathode outputs 4 of the cell of rank n, at least a proportion 24 of these connecting conductors passing beneath the cell of rank n+1 along a path substantially parallel to the large axis of this cell, the direction of the current in these portions 24 of conductors passing from the heads 17 towards the small axis 1.

9 Claims, 3 Drawing Figures

CIRCUIT FOR THE ELECTRICAL CONNECTION OF ROWS OF ELECTROLYSIS CELLS FOR THE PRODUCTION OF ALUMINUM AT VERY HIGH CURRENT

SUBJECT OF THE INVENTION

The invention relates to a circuit for electrical connection between the cells of a row intended for the production of aluminium by electrolysis by the Hall-Heroult process. It is applied to rows of cells arranged transversely to the axis of the row which operate at a current exceeding 250,000 amperes and possibly attaining from 300 to 600 kA, without these values constituting a limit to the field of application of the invention.

STATEMENT OF THE PRIOR ART

For good understanding of the invention it should firstly be remembered that the electrolysis cells for the production of aluminium by electrolysis of alumina dissolved in molten cryolite by the Hall-Heroult process are constituted by an insulated parallelepiped metal container of which the base supports a cathode formed by carbonaceous blocks in which there are sealed some metal rods which project to the exterior of the container on its upstream and downstream sides relative to the direction of the current and form cathode outputs on which there are fixed the conductors which collect the current from one cell and convey it towards the anode system of the following cell. This anode system comprises at least one and usually two horizontal so-called "anode frame" conducting rods supported by at least one rigid horizontal metallic beam which is adjusted in height. The carbonaceous anodes arranged in two parallel lines are supported by conducting shafts which are connected in a detachable manner to each anode frame.

The cells are arranged in rows along one or more lines and they are arranged lengthwise or, nowadays, usually transversely, depending on whether their large side or their small side is parallel to the axis of the line. The cells are connected electrically in series, the ends of the series being connected to the positive and negative outputs of an electric rectification and control substation. In each row of cells, the number of lines is preferably even in order to minimise the lengths of conductors.

The electric current traversing the various conducting elements; anode, electrolyte, liquid metal, cathodes, connecting conductors, creates significant magnetic fields. These fields induce in the electrolysis bath and in the liquid metal contained in the crucible so-called Laplace forces which, by deformation of the upper surface of the molten metal and the movements caused by it, are harmful to the perfect operation of the cell. The layout of the cell and of its connecting conductors is such that the effects of the magnetic fields created by the various portions of the cell and the connecting conductors compensate one another.

Such cells, provided for a current of 280 kA are described, among others, in our Patent Application No. FR A 2 505 368.

It is known that, in order to reduce the investment costs and to reduce the operating costs, there is a tendency to increase the size of the production units, causing an increase in the current traversing each cell. The range of current of the new generations of cells which was recently below 300,000 A, now tends to develop beyond 300,000 A.

At these currents the magnetic effects assume such an amplitude that, if particular precautions were not taken to reduce the effects thereof, the yield of the electrolysis cells would be greatly diminished and, in the final analysis, all normal operation would become impossible.

These disturbances are made obvious by several effects:

deformation of the layer of liquid aluminium which forms on the relatively unwettable carbonaceous cathode which causes risky movements of this layer with, on the one hand, overall uneveness which may attain, in certain cases, a value greater than the distance between the anode and metal and, on the other hand, a symmetrical dome-shaped deformation;

existence of permanent movements of the bath of molten cryolite and of the liquid aluminium of which the configuration may be more or less favourable to the perfect operation of electrolysis;

existence of periodic movements of the bath/metal interface which are harmful to the electrolysis yield (instability) and can go as far, in some cases, as expelling some liquid metal out of the cell.

Furthermore, the possible asymmetry relative to the large axis of the cell of the circulation of the metal has the following disadvantages:

as the mechanical erosion by the liquid aluminium of the slope of solidified cryolite is directly related to the rate of circulation of the metal, asymmetry in these rates of circulation would cause different erosion of the slopes on the two sides of the cell;

the thermal exchanges between the metal and the slop of solidified cryolite are directly related to the rates of circulation of metal; a symmetry of these rates of circulation would cause different thermal exchanges with the two large sides of the cell and would result in a difference in the shape of the slopes from one large side to the other, and this is undesirable for operation of the cells.

In order to overcome the magnetic disturbances it is possible either to act on the horizontal currents circulating in the layer of liquid aluminium or on the magnetic field. In the present case, this second possibility will be made use of.

STATEMENT OF THE PROBLEM

Owing to the increase in the dimensions of the electrolysis cell accompanying the increase in the current traversing each cell, it is becoming more and more difficult to obtain values of magnetic fields allowing the layer of metal to be kept in lasting fashion in a stable position.

To achieve this stability, the vertical components Bz of the magnetic field would have to remain below $10^{-3}$ Tesla in a quadratic mean. Moreover, to stabilise the circulation of bath and to reduce the rates of the metal, the horizontal component Bx must be anti-symmetrical relative to the transverse axis of the cell (small axis) and By must be, on average, anti-symmetrical to the longitudinal axis of the cell (large axis).

The vertical fields can be reduced to acceptable values by using layouts of conductors inspired by cells or weaker intensity. This is achieved by multiplying the number of risers upstream of the cell and by placing them at substantially constant distances but by rendering the horizontal components By asymmetrical.

By way of comparison, whereas only 50 to 75% of the current passes through the upstream risers in cells having an intensity of about 180 kA, the entire current necessarily has to borrow these conductors for cells of approximately 400 kA which are longer, creating markedly asymmetrical horizontal fields.

There is a threshold of current beyond which this asymmetry greatly burdens the technical results by creating intense circulation of bath and of liquid aluminium which destabilises electrolysis.

SUBJECT OF THE INVENTION

In order to render the fields symmetrical again, one might think of placing a riser downstream of the cell. However, to avoid distorting the vertical components of the fields, the connection of this riser should be made by a well selected path utilising the underside of the container and substantially parallel to the longitudinal axis of the container passing from the head towards the centre of the cell at least over a proportion of the path.

The invention relates, in particular, to a configuration of conductors which is applicable to cells having transversely arranged pre-baked anodes and having a current which is higher than 250 kA and can attain from 300 to 600 kA. This configuration permits magnetic field values to be achieved of which the vertical component is less than $10^{-3}$ Tesla everywhere and of which the horizontal components approach the previously determined conditions of anti-symmetry.

FIG. 1 shows schematically, for two successive half cells (which are symmetrical about the small axis 1 of the cell which coincides with the axis of the line) the arrangement of the connecting conductors. This Figure is a plan view reduced to the essential elements. It relates to cells having a current of the order of 480 kA.

Figure 1:
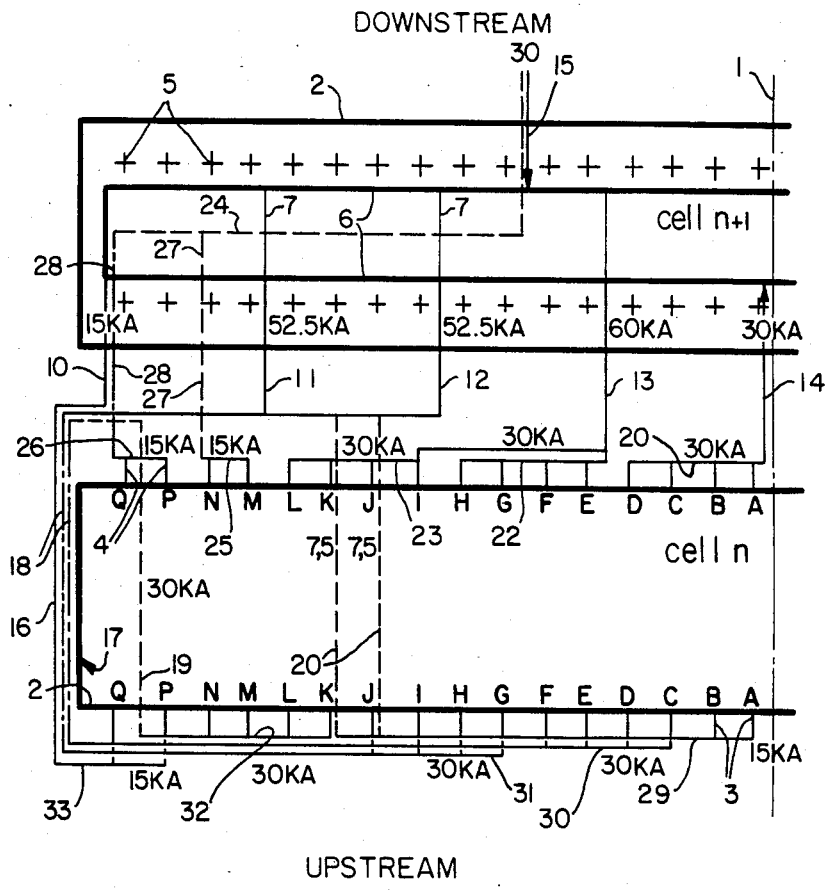
Figure 2:
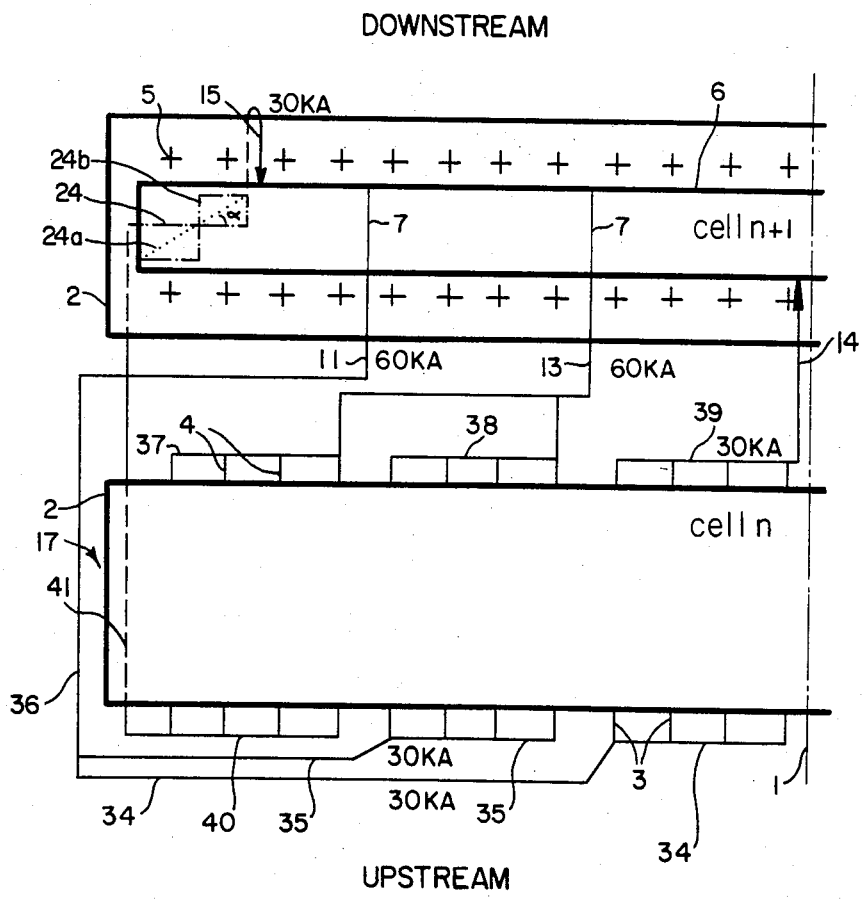
FIG. 2 is similar to FIG. 1, but for cells having a current of approximately 360 kA.
Figure 3:
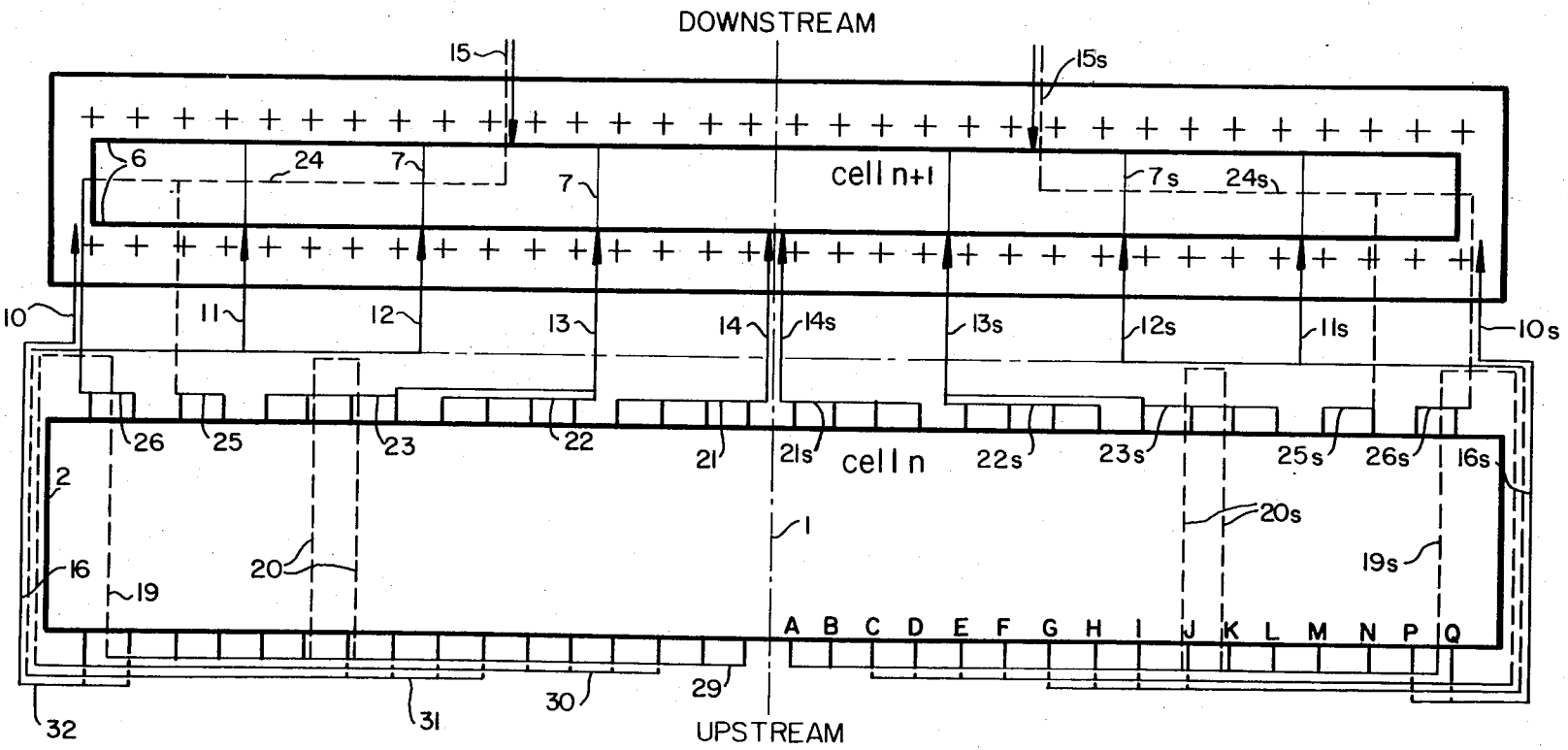
FIG. 3 shows the distribution of the current in the conductors for a 480 kA cells according to the invention.

For the sake of clarity in the Figures, the cathode outputs in FIG. 1 have been represented by thickened lines and, in FIGS. 1 to 3, the various connecting conductors have been represented by simple lines, the routes in broken lines indicating that the conductors pass beneath the level of the base of the container 2.

The contour of the container is indicated by 2, the upstream cathode outputs are designated in their entirety by 3, the downstream cathode outputs in their entirety by 4, the position of the supporting shafts of the anodes by 5, the two elements of the anode frame by 6 and the equipotential conductors connecting them by 7.

In the following description, each conductor will be designated by a reference numeral and the symmetrical conductor relative to the common axis 1 of the line and of the cell by the same reference numeral followed by the letter S (to indicate symmetry).

Other definitions are as follows:

"head riser" will denote the two risers supplying the anode frame at its two ends on the short sides of the cell normally called "heads" of the cell, "axial riser": the riser situated substantially along the small axis 1 of the cell which is also the axis of the line. It may be constituted by two half risers which are juxtaposed or combined in a single conductor, "central risers" will denote the two risers situated on either side of the axial riser if it exists, or if not, on either side (and generally speaking symmetrically) of the small axis 1, "intermediate risers" the riser or risers arranged between the head risers and the central risers.

According to the invention, the anode frame of the cell of rank n+1 in each line is supplied with current simultaneously by a plurality of upstream risers which are substantially equidistant and symmetrical about a vertical plane containing the small axis of the cell and by at least two downstream risers which are substantially symmetrical about the same vertical plane, the downstream risers being supplied by conductors which are connected to the downstream cathode outputs of the cell of rank n, at least a proportion of these connecting conductors passing beneath the cell of rank n+1 along a path which is substantially parallel to the large axis of this cell, the direction of the current in these portions of conductors passing from the heads towards the small axis.

Depending on the intensity of the total electrolysis current supplying the row, the number of upstream risers will be, for example, 5 for the 360 kA cells, 7 for the 420 kA cells and 9 for the 480 kA cells, the number of downstream risers being equal to 2 in these various cases, these only being examples which do not serve to limit the invention strictly to the quoted values (in particular, the number of upstream risers may be even or uneven).

It should also be pointed out that, in view of the mechanical requirements for construction of cells of this size, the expression "equidistant" should not be interpreted in the strict geometric sense, but it means that the risers are arranged at regular intervals in the free space between the assemblies formed by the anodes and their systems for suspension and locking on the anode frame so as not to obstruct the operations for removal of the worn anodes and their replacement by new anodes. The same applies to the notion of "symmetry" which should be interpreted with the same reservations.

In order to carry out the invention with a 480 kA cell, as shown in FIGS. 1 and 3, 9 upstream risers are provided and are distributed as follows: one head riser 10 (and the symmetrical riser 10S on the other half of the cell), two intermediate risers 11, 12 and the symmetrical risers 11S, 12S on the other half of the cell, and one central riser 13 and the symmetrical riser 13S on the other half of the cell, and one axial riser 14, 14S constituted by two half risers which are juxtaposed or even combined and are arranged along the common axis 1 of the cell and of the row.

The two downstream risers are the riser 15 and the symmetrical riser 15S on the other half of the cell.

The head risers 10 and 10S are supplied from upstream cathode collectors by a conductor 16, 16S passing round the exterior of the head 17 of the cell, that is the end of the metal container 2. The intermediate risers 11, 12, 11S and 12S are supplied from the upstream cathode collectors, both by a conductor 18, 18S which also passes round the head 17 of the cell and by a conductor or a group of conductors 19, 19S passing beneath the head 17 of the cell and by a conductor or a group of conductors 20, 20S passing beneath the metal container 2. The central risers 13, 13S and the axial riser 14, 14S are supplied merely from the central downstream cathode collectors such as 21, 22 and 23–21S, 22S, 23S. Finally, the downstream risers 15 and 15S are supplied by a longitudinal conductor 24 passing beneath the large axis of the cell n+1 from the downstream cathode collectors 25, 26, 25S, 26S situated on the side of the head, by means of connecting conductors 27, 28, 27S, 28S passing beneath the head of the cell n+1 and then rejoining the longitudinal conductor 24, 24S.

The connections for the cathode collectors to the various cathode outputs (16 upstream outputs 3A to 3P and 16 downstream outputs, 4A to 4P) are made in the following manner:

Upstream the cathode outputs 3A and 3B are connected to the collector 29 which is itself connected to the rods 20 passing beneath the cell, the cathode outputs 3C, 3D, 3E, 3F are connected to the collector 30 which is itself connected to one of the rods 18 turning round the head 17 of the cell, the cathode outputs 3G, 3H, 3I and 3J are connected to the collector 31 connected to the second rod 18 which passes round the head 17 of the cell, the cathode outputs 3K, 3L, 3M, 3N are connected to the collector 32 connected to the rod 19 which passes beneath the head 17 of the cell, the cathode outputs 3P and 3Q are connected to the collector 33 which is connected to the rod 16 passing round the head 17 of the cell.

Downstream the cathode outputs 4A, 4B, 4C, 4D are connected to the collector 21 which supplies the axial half riser 14, the cathode outputs 4E, 4F, 4G, 4H are connected to the collector 22 which supplies the central riser 13, the cathode outputs 4I, 4J, 4K, 4L are connected to the collector 23 which also supplies the central riser 13, the cathode outputs 4M, 4N are connected to the collector 25 which, via the rod 27, connects the longitudinal conductor 24 arranged beneath the cell n+1 and which supplies the downstream riser 15, the cathode outputs 4P, 4Q are connected to the collector 26 which also joins the conductor 24 and the downstream riser 15 via the rod 28.

In order to obtain a distribution and a value of the components of the magnetic field corresponding to the object set, the distribution of the current in these various conductors should be within the following limits, expressed as a percentage of the total current J traversing each cell for values of J higher than approximately 400 kA.

In each head riser 10 and 10S: 1 to 6% of J.

In each intermediate riser 11, 12, 11S, 12S: 8 to 15% of J.

In each central and axial riser 13, 14+14S and 13S: 9 to 16% of J.

In each downstream riser 15, 15S: 3 to 9% of J.

With regard to the connecting conductors:

In the conductors 16+18 and 16S+18S passing round each head: 10 to 20% of J.

In each of the conductors 19 and 19S beneath the heads: 3 to 10% of J.

In each of the conductors 20 and 20S passing beneath the container: 0.5 to 6.5% of J.

In each of the longitudinal conductors 24, 24S: 3 to 9% of J.

In the case of a 360 kA cell, shown in FIG. 2, the same principles and the same constructional characteristics are adopted with some simplifications linked to the lowest intensity. There are now 5 upstream risers which are distributed as one 60 kA intermediate riser 11 and the symmetrical riser 11S (not shown), a central 60 kA riser 13 and the symmetrical riser 13S (not shown) and an axial riser constituted by two half risers at 30 kA which are juxtaposed or even combined 14 and the symmetrical riser 14S (not shown). With respect to a 480 kA cell, therefore, the two head risers and two intermediate risers have been eliminated.

A downstream 30 kA riser 15 and the symmetrical riser 15S (not shown) are found again. In each half cell:

the intermediate riser 11 is supplied from the upstream cathode collectors 34, 35 of the preceding cell of rank n by a conductor 36 passing round the head of the cell, the central riser 13 is supplied from the downstream cathode collectors 37, 38, the axial half riser 14 is supplied from the downstream cathode collector 39, finally, the downstream riser 15 is supplied from the upstream cathode collector 40 by a conductor 41 which passes beneath the head of the cell n then beneath the upstream corner of the cell n+1 and rejoins a longitudinal conductor 24 arranged beneath the container and of which a proportion is substantially parallel to the large axis of the cell.

To achieve a distribution and a value for the components of the magnetic field corresponding to the object set, the distribution of the current in these various conductors should be within the following limits, expressed as a percentage of the total current J traversing each cell. For values of J between 300 and 400 kA, and for 5 upstream risers plus 2 downstream risers.

In each intermediate riser 11, 11S: 12 to 22% of J.

In each central riser 13, 13S: 12 to 22% of J.

In each axial half riser 14, 14S: 6 to 12% of J.

In each downstream riser 15, 15S: 6 to 12% of J.

The distribution of the cathode outputs between the various upstream cathode collectors 34, 35, 40 and downstream collectors 37, 38, 39 (and the symmetrical collectors) is shown clearly in FIG. 2 and does not require a special commentary.

It should also be noted that the longitudinal conductor 24 which supplies the downstream riser 15 can form with the longitudinal axis of the cell an angle $\alpha$ (route 24A in fine broken lines) without a significant effect on the vertical component Bz of the magnetic field in the region of the bath/metal interface. The interval can be estimated at less than $1.10^{-4}$ Tesla for a $\alpha=30°$. The same applies to the "stepwise" path (24B in alternate dots and dashes), leaving a certain margin for manoeuvre during assembly as a function of the space required beneath the container of the cell.

COMPENSATION OF THE ADJACENT LINE

When the rows of electrolysis cells are arranged in one or more parallel lines, it is generally essential, for achieving the maximum stability and Faraday yeild to compensate the parasitic magnetic field induced on each line by the current circulating in the adjacent line. This compensation may be effected in combination with the present invention by one of the processes described in the prior Patents granted to the Applicant and, in particular, in French Pat. No. FR 2 333 060 (=U.S. Pat. No. 4,072,597) according to which asymmetry is created relative to the axis of the series in the arrangement of the cathode collectors, in French Pat. No. FR 2 343 846 (U.S. Pat. No. 4,090,930) according to which an antagonistic magnetic field substantially equal to and of opposing sign to the field induced by the adjacent line is created at the head of the cell closest to the adjacent line, by forming a loop with a branch conductor passing beneath the head of the cell, or in French Pat. No. FR 2 425 482 (=U.S. Pat. No. 4,169,034) according to which a conductor traversed by a current having its intensity and direction selected so as to compensate the parasitic field induced by the adjacent line or lines is arranged along each line and on only one side or on both sides. In the present case, compensation may be achieved by arranging the upstream cathode collectors and/or the downstream cathode collectors and/or the connecting conductors passing beneath the cell in an asymmetrical manner relative to the axis of the row, or again by connecting at least one cathode collector situated on one side of the cell to a number of cathode rods different from the number of rods to which the corresponding collector situated on the other side of the cell is connected so as to compensate the magnetic field induced by one or more lines of cells arranged parallel to the line under consideration and at a short distance from it.

EMBODIMENT

The invention has been applied to a small experimental row of cells operating at 480 kA, each cell being equipped with two lines of 32 pre-baked anodes and being provided over each large side (upstream and downstream) with 32 cathode outputs each extracting 7.5 kA. The distributions of current were as follows for the entire cell:

| Conductor | No. | current kA | % J | Total current kA |
|---|---|---|---|---|
| Head Risers 10, 10S | 2 | 15 | 3.1 | 30 |
| Intermediate Risers 11, 12, 11S, 12S | 4 | 52.5 | 10.9 | 210 |
| Central Risers 13, 14, 14S, 13S | 3 | 60 | 12.5 | 180 |
| Downstream Risers 15, 15S | 2 | 30 | 6.25 | 60 |
| TOTAL | | | 100 | 480 |
| Head Conductors 16, 18, 16S, 18S | 2 | 75 | 15.6 | 150 |
| Conductors Beneath Head 19, 19S | 2 | 30 | 6.25 | 60 |
| Conductors Beneath Container 20, 20S | 2 | 15 | 3.1 | 30 |
| Longitudinal Conductor 24, 24S | 2 | 30 | 6.25 | 60 |
| N.B. The difference, that is 180 kA passes through the 2 central risers 13, 14. | | | | 300 |

(These values have been shown in FIG. 1 on each of the conductors concerned).

The following values of the magnetic field were measured on each cell in the region of the layer of metal:
Bz maximum value found: $2.10^{-3}$ Tesla
Bz quadratic-mean: $5.10^{-4}$ Tesla
By means over the longitudinal axis: $5.3.10^{-4}$ Tesla
By maximum: $140.10^{-4}$ Tesla These cells have demonstrated remarkable stability in experimental operation and have produced aluminium with a Faraday yield of between 94 and 95%. This yield could not have been obtained or even approached by the currently used designs of circuits.

We claim:

1. In a circuit for electrical connection between at least two successive cells of rank n and rank n+1 in a row of cells for the production of aluminium by electrolysis of alumina dissolved in molten cryolite by the Hall-Heroult process at a total electrolysis current J higher than 250,000 amperes, and possibly attaining 300 to 600 kA, each cell being constituted by an insulated parallelepiped metal container of which the large axis is perpendicular to the axis of the row and the small axis parallel to the axis of the row, the two ends of the container comprising heads, the container supporting a cathode formed by the juxtaposition of carbonaceous blocks in which there are sealed metal rods of which the rod ends issue from the container generally on its two large upstream and downstream sides relative to the direction of the current in the line, each cell also comprising an anode system formed by at least one horizontal rigid beam supporting at least one horizontal conducting rod comprising an anode frame on which the shafts for suspension of the anodes are attached, the circuit for connection between two successive cells being constituted by cathode collectors which are connected on the one hand to the cathode outputs of the cell of rank n and on the other hand to the connecting conductors which join, via risers, the anode frame of the cell of rank n+1 in the row, the improvement comprising the anode frame (6) of the cell of rank n+1 in the row being supplied with current simultaneously via a plurality of upstream risers such as (11, 12, 13) which are substantially equidistant and symmetrical relative to the vertical plane containing the small axis (1) of the cell and by at least two downstream risers (15) (15S) which are substantially symmetrical to this same vertical plane, these downstream risers (15, 15S) being supplied by conductors connected to the downstream cathode outputs (4) of the cell of rank n, at least one portion (24) of these connecting conductors passing beneath the cell of rank n+1 along a path substantially parallel to the large axis of this cell, the direction of the current in these portions (24) of conductors passing from the heads (17) towards the small axis (1) of the cell.

2. A connecting circuit according to claim 1, including at least five upstream risers and at least two downstream risers.

3. A circuit for electrical connection according to claim 2, wherein in operating at a current of from 300 to 400 kA, means is provided for the total current J traversing the cell to be distributed in the following manner:

(a) in each intermediate riser (11, 11S): 12 to 22% of J;
(b) in each central riser (13, 13S): 12 to 22% of J;
(c) in each axial half riser (14, 14S): 6 to 12% of J; and
(d) in each downstream riser (15, 15S): 6 to 12% of J.

4. A connecting circuit according to claim 1, including nine upstream risers and two downstream risers supplied from the cathode outputs of the preceding cell, and wherein:

(a) the head risers (10, 10S) are connected to the upstream cathode collectors (3) by a conductor (16, 16S) passing to the exterior of each head (17) of the cell:
(b) the intermediate risers (11, 11S, 12, 12S) are supplied at least in part from the upstream cathode collectors (29, 29S, 30, 30S, 31, 31S, 32, 32S) by a conductor (18, 18S) pasing round each head (17) of the cell by at least one conductor (19, 19S) passing beneath each head (17) and by at least one conductor (20, 20S) passing beneath the metal container (2);
(c) the central risers (13, 13S, 14, 14S) are connected respectively to the downstream central cathode collectors (21, 22, 23 and 21S, 22S, 23S); and (d) the downstream risers (15, 15S) are connected respectively to the downstream cathode collectors (25, 26 and 25S, 26S) situated on the side of the heads (17) by connecting conductors (27, 28, 27S, 28S) passing beneath the head of the cell n+1 and joining a conductor (24, 24S) arranged beneath the container substantially perpendicularly to the large axis of the cell.

5. A connecting circuit according to claim 3, wherein on each cell, the cathode collectors are connected to the cathode outputs (3,4) and wherein:

(a) the upstream cathode outputs (3A and 3B) are connected to the collector (29) which is itself connected to the rods (20) passing beneath the cell;

(b) the upstream cathode outputs (3C, 3D, 3E, 3F) are connected to the collector (30) which is itself connected to one of the rods (18) which pass round the head (17) of the cell;

(c) the upstream cathode outputs (3G, 3H, 3I, 3J) are connected to the collector (31) which is connected to the second rod (18) which passes round the head (17) of one cell;

(d) the upstream cathode outputs (3K, 3L, 3M, 3N) are connected to the collector (32) which is connected to the rod (19) passing beneath the head (17) of the cell;

(e) the upstream cathode outputs (3P, 3Q) are connected to the collector (33) which is itself connected to the rod (16) which passes round the head (17) of the cell;

(f) the downstream cathode outputs (4A, 4B, 4C, 4D) are connected to the collector (21) which supplies the axial half riser (14);

(g) the downstream cathode outputs (4E, 4F, 4G, 4H) are connected to the collector (22) which supplies the riser (13);

(h) the cathode outputs (4I, 4J, 4K, 4L) are connected to the collector (23) which also supplies the riser (13);

(i) the downstream cathode outputs (4M, 4N) are connected to the collector (25) which, via the rod (27), joins the longitudinal conductor (24) arranged beneath the cell n+1 and which supplies the downstream riser (15); and (j) the cathode outputs (4R, 4Q) are connected to the collector (26) which, via the rod (28), also joins the conductor (24) and the downstream riser (15).

6. A circuit for electrical connection according to claim 3, wherein in a cell operating at a current higher than 400 kA means is provided for the total electrolysis current J traversing the cell to be distributed in the following manner:

(a) in each head riser (10, 10S): 1 to 6% of J;

(b) in each intermediate riser (11, 11S, 12, 12S): 8 to 15% of J;

(c) in each central riser (13, 13S, 14, 14S): 9 to 16% of J; and (d) in each downstream riser (15, 15S): 3 to 9% of J.

7. A circuit for electrical connection according to claim 3, wherein means is provided wherein the fraction of current traversing the connecting conductors is controlled in the following manner:

(a) in the conductors (16, 16S, 18, 18S) passing round the heads: from 10 to 20% of J;

(b) in each of the conductors (19, 19S) passing beneath the heads: from 3 to 10% of J;

(c) in each of the conductors (20 and 20S) passing beneath the container: 0.5 to 6.5% of J; and (d) in each longitudinal conductor (24, 24S): from 3 to 9% of J.

8. A connecting circuit according to claim 1, 2 or 3, wherein the upstream cathode collectors and/or the downstream cathode collectors and/or the connecting conductors passing beneath the cell are asymmetrical about the axis of the row so as to compensate the magnetic field induced by one or more lines of cells arranged parallel to the first and at a short distance from it.

9. A connecting circuit according to claim 8, wherein the asymmetry is provided by connection of at least one cathode collector situated on one side of the cell to a number of cathode rods different from the number of rods to which the corresponding collector situated on the other side of the cell is connected.

* * * * *